US006589674B2

(12) United States Patent
Li et al.

(10) Patent No.: US 6,589,674 B2
(45) Date of Patent: Jul. 8, 2003

(54) INSERTION LAYER FOR THICK FILM ELECTROLUMINESCENT DISPLAYS

(75) Inventors: Wu Li, Brampton (CA); Yongbao Xin, Etobicoke (CA); Michael R. Westcott, Oakville (CA)

(73) Assignee: iFire Technology Inc., Fort Saskatchewan (CA)

( * ) Notice: Subject to any disclaimer, the term of this patent is extended or adjusted under 35 U.S.C. 154(b) by 0 days.

(21) Appl. No.: 09/761,971

(22) Filed: Jan. 17, 2001

(65) Prior Publication Data

US 2002/0094451 A1 Jul. 18, 2002

(51) Int. Cl.[7] ..... H05B 33/22

(52) U.S. Cl. ..... 428/690; 428/917; 313/506; 313/509

(58) Field of Search ..... 428/690, 917, 428/212, 213, 332, 697, 701, 702; 313/502, 506, 509

(56) References Cited

U.S. PATENT DOCUMENTS

| | | | | |
|---|---|---|---|---|
| 4,486,487 A | | 12/1984 | Skarp | 428/216 |
| 4,897,319 A | | 1/1990 | Sun | 428/690 |
| 5,309,070 A | | 5/1994 | Sun et al. | 313/503 |
| 5,432,015 A | | 7/1995 | Wu et al. | 428/690 |
| 5,742,322 A | | 4/1998 | Cranton et al. | 347/238 |
| 5,756,147 A | | 5/1998 | Wu et al. | 427/66 |
| 5,912,532 A | | 6/1999 | Oh et al. | 313/503 |
| 6,025,677 A | | 2/2000 | Moss, III et al. | 313/503 |
| 6,207,302 B1 | * | 3/2001 | Sugiura et al. | 428/690 |
| 2001/0003614 A1 | * | 6/2001 | Nagano et al. | 428/210 |

FOREIGN PATENT DOCUMENTS

| | | |
|---|---|---|
| JP | 2 195 682 | 8/1990 |
| WO | WO 00/70917 | 11/2000 |

OTHER PUBLICATIONS

Abstract, JP 59 0478979 B (Omron Tateisi Electronics Co.), Nov. 12, 1984, Derwent Publications, Ltd., Document XP–002203043.

INSPEC/Institute of Electrical Engineers, Stevenage, GB; "Characterisation of the BaTio/sub 3//p–Si interface and applications", E.K. Evangelou et al, and Seventh Int'l Conference on the Formation of Semiconductor Interfaces, Goteborg, Sweden Jun. 21–25, 1999; vol. 166, pp. 504–507, Applied Surface Science, Oct. 9, 2000.

Introduction to Solid State Physics (Third Edition) by Charles Kittel; Chap. 13, p. 419, Jun., 1968.

SrS:Ce Hybrid Electroluminescent Devices with $BaTiO_3$ Thick–Film Dielectric Layer by Haruki Fukada, et al. (No Date).

* cited by examiner

*Primary Examiner*—Cynthia H. Kelly
*Assistant Examiner*—Dawn Garrett
(74) *Attorney, Agent, or Firm*—Libert & Associates; Victor E. Libert; Frederick A. Spaeth

(57) ABSTRACT

The performance and stability of thick film electroluminescent displays is enhanced by a non-porous layer inserted between the thick film dielectric layer and thin film phosphor structures in these displays. The inserted layer facilitates increased luminance, increased energy efficiency and improved operating stability.

27 Claims, 6 Drawing Sheets

Figure 1
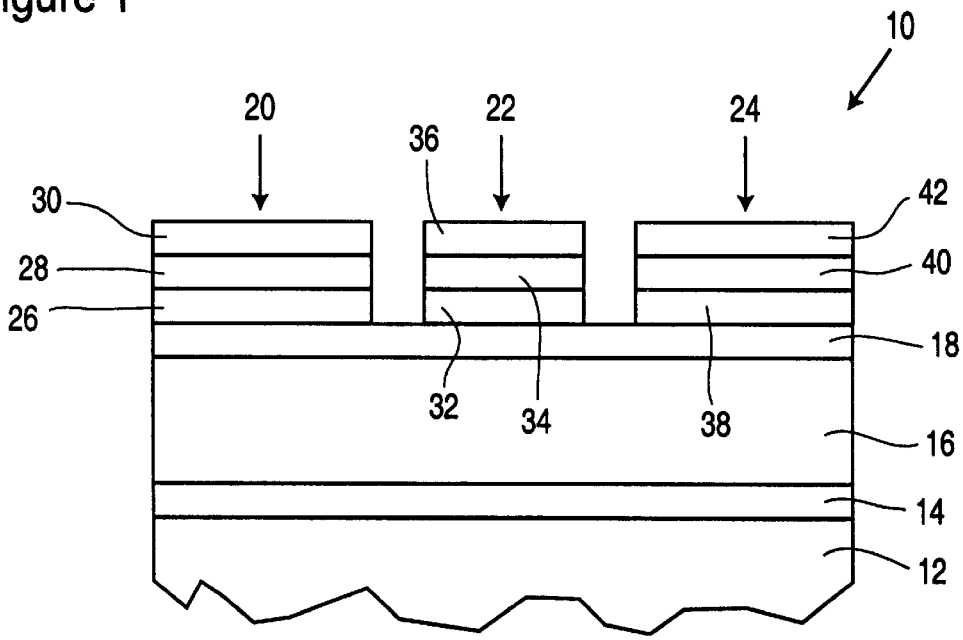
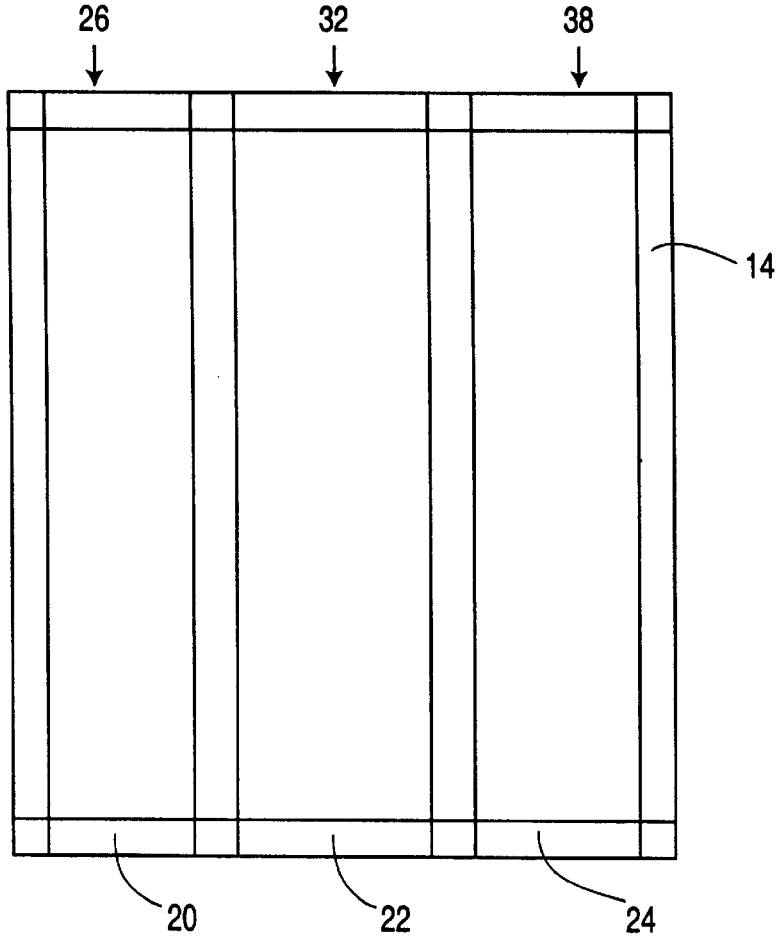
Figure 2

INSERTION LAYER FOR THICK FILM ELECTROLUMINESCENT DISPLAYS

FIELD OF THE INVENTION

The present invention relates to insertion layers for thick film electraluminescent displays, and especially to a non-porous layer between the thick film dielectric layer and the phosphor in such displays.

The term "non-porous" as used in this patent application means that the layer inhibits the transport of deloterious atomic species across the layer to the extent required to substantially prevent performance degradation of the electroluminscent display, and especially phosphors therein., due to migration of these species into the phosphor layer.

BACKGROUND OF THE INVENTION

The present invention relates to improving the luminance and operating stability of electroluminescent display having thick film dielectric layers with a high dielectric constant. In such displays, a display pixel is addressed by applying a voltage between a selected address row and a selected address column on opposite sides of a phosphor film sandwiched between two dielectric layers, one of which is a thick film dielectric layer. The applied voltage creates an electric field across the phosphor film at the pixel located at the intersection of the selected row and column site.

A significant advantage of electroluminescent displays with thick film dielectric layers over traditional thin film electroluminescent (TFEL) displays is that the thick film high dielectric constant layer may be made sufficisntly thick to prevent dielectric breakdown. The high relative dielectric constant of the materials that are used minimizes the voltage drop across the dielectric layer when a pixel is illuminated. In order to prevent dielectric breakdown, the thick film layer is typically comprised of a sintered perovskite, piezoelectric or ferroelectric material e.g. PMN PT, with a relative dielectric constant of several thousand and a thickness greater than about 10 micrometers. PMN-PT is a material that includes lead and magnesium niobates and titanates. An additional thinner overlayer of a compatible piezoelectric material eg. lead zirocante titanate, may be applied using metal organic deposition (MOD) or sol gel techniques, to smooth the surface of the thick film for subsequent deposition of a thin film phosphor structure. The processes used to deposit the overlayer are typically practical for deposition of layers of not more than about 3 micrometers and thus are not suitable for deposition of the primary component of the thick film dielectric layer. In addition, the relative dielectric constants of the materials deposited using sot gel or MOD processes are significantly lower than that of PMN-PT, being typically less than 1000, but the dielectric breakdown strengths are comparable. The consequence is that substantially thicker layers would need to be used as the primary thick film dielectric that prevents dielectric breakdown, and this is not a practical option.

A thick film dielectric electroluminescent display is constructed on a ceramic or other heat resistant substrate. The fabrication process for the display entails first depositing a set of row electrodes on the substrate. A thick film dielectric layer is deposited on the substrate using thick film deposition techniques that are exemplified in U.S. Pat. No. 5,432,015. A thin film structure comprised of one or more thin film dielectric layers sandwiching one or more thin phosphor films is then deposited, followed by a set of optically transparent column electrodes using vacuum techniques as exemplified by published PCT patent application WO 00/70917 of Wu et al. The entire resulting structure is covered with a sealing layer that protects the thick and thin film structures from degradation due to moisture or other atmospheric contaminants. The thick film electroluminescent display structure that is obtained provides for superior resistance to dielectric breakdown as well as reduced operating voltage, compared to thin film electroluminescent (TFEL) displays. This is due to the high relative dielectric constant of the thick film dielectric materials that are used, which facilitates the use of thick layers while still permitting an acceptably low display operating voltage.

The thick film dielectric structure, when it is deposited on a ceramic substrate, will also withstand higher processing temperatures than TFEL devices, which are typically fabricated on glass substrates. The increased temperature tolerance facilitates annealing of subsequently deposited phosphor films to improve luminosity, However, even with these enhancements, thick film electroluminescent displays have not achieved the phosphor luminance and colour coordinates needed to be fully competitive with cathode ray tube (CRT) displays, particularly with recent trends in CRT specifications to higher luminance and colour temperature. Increased luminance can be realized by increasing the operating voltage, but this increases the power consumption of the displays, decreases reliability and increases the cost of driving electronics for the displays.

Increased luminance can also be achieved by using a patterned phosphor structure, instead of the traditional unpatterend white emitting phosphor systems used for TFEL displays. This reduces optical losses in the filters that are used to achieve acceptable CIE colour coordinates for red, green and blue emissions by at least partially matching the emission spectra of the phosphors to that required to achieve the needed CIE coordinates for each colour. However, such patterning requires the use of photolithographic processes to fabricate high-resolution displays. The use of photolithography for electroluminescent phosphors, as exemplified by the aforementioned published PCT patent application WO 00/70917, requires the deposition of photoresist films and the etching or lift-off of portions of the phosphor films to provide the required pattern. Deposition and removal of photoresist films and etching or lift-off of phosphor films typically requires the use of solvent-based solutions that contain water or other reactive solvents and solutes. These solutions or any residue may react with the underlying display structure, thereby degrading the performance of the completed display device. The degradation may increase if the residues of the solutions become trapped and then diffuse within the structure during subsequent phosphor annealing steps.

The performance of thick film electroluminescent displays can be enhanced by judicious choice of thin film dielectric layers used to sandwich the phosphor films used in the displays. The enhanced performance is related to the inhibition of transportation of deleterious species from the thick film structure to the thin film structure and causing degradation of phosphor performance. In addition, there is an increase in the effective surface density of electrons injected into the phosphor film under conditions appropriate to generation of light. Nevertheless, such thin film dielectric layers have limitations. If the thin film dielectric layers are made thicker so as to be more effective to inhibit diffusion of atomic species, there is an increased voltage drop across the layers relative to the voltage across the phosphor film required for electron injection into the phosphor to generate light. The increased voltage drop results in a requirement for a higher display operating voltage, the disadvantages of which have been discussed above.

SUMMARY OF THE INVENTION

A non-porous insertion layer for thick film electroluminescent displays has now been found.

Accordingly, one aspect of the present invention provides in a thick film electroluminescent display having a thick film dielectric layer and phosphor layer, the improvement comprising:

an adherent thin non-porous layer interposed between the thick film dielectric layer and the phosphor layer, said thin non-porous layer comprising a crystaline material having a crystal structure with a permanent or electric-field induced dipole moment;

said thin non-porous layer being chemically more stable with respect to the phosphor layer than the thick film dielectric layer;

said non-porous layer exhibiting reduced diffusion characteristics to atomic species than the thick film dielectric layer.

In preferred embodiments of the invention, the crystal structure does not have a centre of inversion symmetry.

In further embodiments, the non-porous layer is adjacent both the thick film dielectric layer and the phosphor layer, or the non-porous layer is adjacent to (i) a smoothing dielectric layer on the thick film dielectric layer and to (ii) the phosphor layer.

In other embodiments, the non porous layer is paraelectric, ferroelectric or anti-ferroelectric.

In still further embodiments, the non-porous layer has a relative dielectric constant of greater than 20, especially greater than 50 and in particular greater than 100.

In preferred embodiments, the non-porous layer is formed from a compound of the formula $Ba_xSr_{1-x}TiO_3$, where $0 \leqq x \leqq 1$, or $BaTa_2O_6$, especially barium titanate.

In further embodiments, the non-porous layer has a thickness of 0.05–1.0 micrometers, especially a thickness of 0.1–0.3 micrometers.

In still further embodiments of the present invention, a thin film dielectric layer is applied on the phosphor layer, especially a thin film dielectric layer that is $Al_2O_3$ or $BaTiO_3$.

In preferred embodiments, a layer of indium tip oxide is applied over the thin film dielectric layer.

BRIEF DESCRIPTION OF THE DRAWINGS

The present invention is illustrated by the embodiments shown in the drawings, in which:

FIG. 1 is a schematic representation of a cross-section of an electroluminescent element of the prior art;

FIG. 2 is a schematic representation of a plan view of an electroluminescent element of FIG. 1;

DETAILED DESCRIPTION OF THE INVENTION

Figure 3:
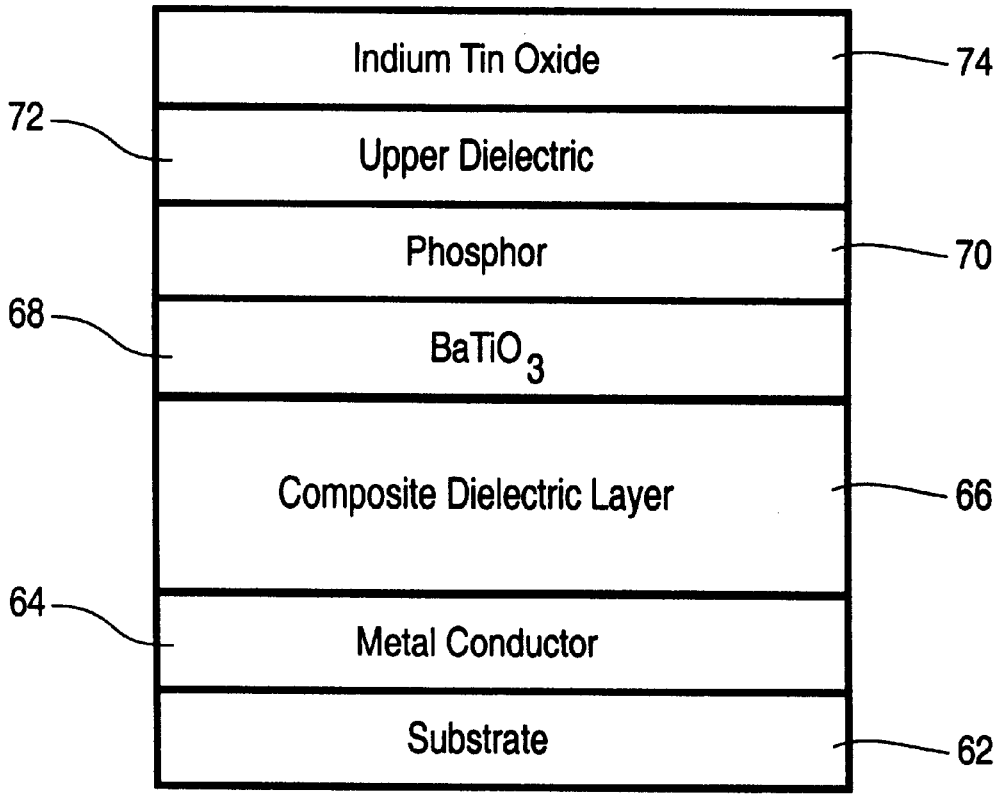
FIG. 3 is a schematic representation of a cross-section of an electroluminescent element showing an insertion layer of the present invention.

The present invention relates to the insertion of a thin non-porous layer between the thick film dielectric layer and the phosphor layer in a thick film electroluminescent display. In the event that the thick film electrolumninescent display has multiple phosphor layers, the thin non-porous layer is interposed between the thick film dielectric layer and the phosphor layer juxtaposed thereto.

The thin non-porous layer is comprised of a crystalline material that has a crystal structure that facilitates the formation of a permanent or electric field-induced dipole moment in the crystalline material. In particular, the crystalline material lacks a center of inversion symmetry, which facilitates the formation of the permanent or electric field-induced dipole moment. The thin non-porous layer is inserted, or interposed, between the thick film dielectric layer and the phosphor layer, or the phosphor layer juxtaposed thereto, of the electroluminescent display for the purpose of improving luminance and operating stability. As described herein, the electroluminescent device may have one or more dielectric layers between the thick film dielectric layer and the phosphor layer, especially on the thick film dielectric layer. Such layers may act as smoothing layers on the thick film dielectric layer. The non-porous layer may be adjacent to any such layers.

The crystalline material may be paraelectric, ferroelectric or anti-ferroelectric, as understood by the usual scientific definition of these terms as referenced for example on page 419 of C. Kittel, Introduction to Solid State Physics, third edition 1968 (J. Wiley & Sons, New York), It is understood that the non-porus layer does not include materials through which certain deleterious atomic species may migrate, and in particular does not include materials such as lead titanate zirconate (PZT) or PMN-PT Such materials contain lead which readily diffuses at high temperature e.g. during deposition or annealing of the phosphor. In addition, PZT and PMT-PT have tendencies to react with phosphors. An important reason for the use of a layer $Al_2O_3$ in the prior art is to reduce chemical reaction and diffusion of lead.

In preferred embodiments of the present invention, the crystalline material of the non-porous layer has a relative dielectric constant that is greater Than about 20, especially greater than about 50 and especially greater than about 100.

In embodiments of the invention, the crystalline material of the non-porous layer is a ternary or quaternary compound containing three or four chemical elements. In particular, the non-porous layer may be formed from a compound of the formula $Ba_xSr_{1-x}TiO_3$, where $0 \leqq x \leqq 1$ or $BaTa_2O_6$. The preferred material is barium titanate.

The non-porous crystalline layer may be 0.05 to 1.0 micrometers thick, and preferably 0.1 to 0.3 micrometers thick. Such thicknesses are signficantly less than the thicknesses of either the primary thick film dielectric layer or the overlying surface smoothing layer that is generally applied to the electroluminescent device as described herein. The thickness of the crystalline layer is limited in part by the Sol gel or vacuum deposition processes used in deposition of the layer and in part by the relatively low dielectric constant of the material of the non-porous layer in comparison to the primary thick film dielectric material. The crystalline layer may serve the purpose of thin film dielectric layers described herein and may replace one or more of them. As a result of the high dielectric constant of the crystalline layer relative to typical thin film dielectric materials, the layers can be made relatively thicker without suffering an unduly large voltage drop across the layer. This provides improved resistance to diffusion of atomic species across the layer.

It is understood that there may be an increased electric charge at the surfaces of the non-porous layer in the present invention relative to the electric charge that would be present if the layer was formed from for example alumina or silicon oxynitride. The latter have relative dielectric constants of less than 10, and have been used previously for the thin film dielectric layers in electroluminescent displays It is understood that under the appropriate circumstances, the increased charge may increase the surface density of electrons injected into the phosphor, facilitating increased luminosity.

The improved resistance to diffusion of atomic species facilitates the use of higher phosphor annealing temperatures, a wider range of annealing atmospheres and longer annealing times. There may also be a reduction in degradation of the performance of the electrolumninescent display during operation by inhibition of diffusion of atomic species from the thick film structure into the phosphor and adjacent thin film structures. In the absence of an appropriate barrier, such diffusion may be significant, even at ambient temperature, when electric fields are present within the display structure.

It is understood that the non-porous crystalline layer of the present invention must not react in an unfavourable manner with various chemical species that may come into contact with the non-porous layer during any of the various stages of fabrication of the electroluminescent display, subsequent to deposition of the non-porous layer. Such species include those in thin film dielectric layers that encapsulate phosphor films, the phosphor films per se, as wall as photoresist materials and etchants used in photolithographic processes that may be associated with fabrication of the display. Thus, the composition of adjacent layers, the chemicals used in process steps subsequent to the deposition of the barium titanate layer and the process steps that are used must be selected to be compatible with the selected non-porous crystalline layer. In particular, the non-porous layer must be more stable with respect to phosphor materials than the thick film dielectric layer. Reactions of phosphor with the non-porous layer during phosphor deposition and phosphor annealing steps are to be avoided or minimized. It is particularly preferred that there be no such reaction. PIT and PMN-PT do not meet such requirements because of chemical reactions with phosphors during deposition and annealing.

It is understood that a further requirement is that the non-porous layer must be adherent to the layers that it comes in contact with, i.e. the layers immediately below and above the non-porous layer in the display structure. Typically, one such layer is a high dielectric material such as lead zirconetetitanate (PZT), and the other such layer is a phosphor film or a thin film dielectric layer chosen to provide optimum electron injection into the phosphor. It is understood that the adherence of the layers is dependent on the interfacial surface tension between the materials of the adjacent layers, which is related to the strength of chemical bonding across the interface relative to the chemical bond strengths parallel to the interface. Thus, the composition of the layers in contact with the non-porous crystalline layer is chosen to facilitate adequate adhesion between these layers and the non-porous crystalline layer so that delamination of the layers does not occur during fabrication or operation of the display.

There may be factors in the ability of the non-porous crystalline layer of the present invention to impede diffusion of atomic species that are in addition to the increase in thickness of the layer due to its high dielectric constant. It is understood that transport of atomic species may occur via several mechanisms. In what is believed to be the order of decreasing importance, these are as follows: (a) Transport may occur though pinholes in the non-porous layer by vapour transport or surface diffusion. These are relatively rapid processes, and minimization of the number and size of pinholes in the layer is an important consideration. (b) Atomic diffusion may occur along grain boundaries, also at a relatively rapid rate, and minimization of the real density of grain boundaries is desirable. (c) Transport may occur by bulk diffusion through the crystal lattice of individual grains, which occurs by atomic species hopping between vacancies in the crystal lattice or by hopping from one interstitial site to another. Typically, the process of hopping between vacancies occurs faster, since the vacancies will more readily accommodate hopping atoms. Diffusion between interstitial sites tends to be lowest for crystal lattices having a high atomic density, since these lattices have smaller interstices. Thus, the factors in the development of a good diffusion barrier include the crystal structure, as well as grain structure and morphology of the deposited film. Such factors may be use in selection of possible alternate diffusion barrier materials.

Although the inserted layer is described herein as "non-porous" it will be appreciated that a layer that completely inhibits transport of atomic species is unattainable in the context of the invention. The non-porous layer is understood to reduce or inhibit transport of atomic species, with the result of improved electroluminescent properties.

It is understood that an upper thin film dielectric layer is typically applied onto the phosphor layer, followed by a layer of for example indium tin oxide. The thin film dielectric layer is typically aluminum oxide ($Al_2O_3$) However, in an embodiment of the present invention, the upper thin film dielectric layer may also be a non-porous layer as described herein, especially barium titanate ($BaTiO_3$).

FIG. 1 shows a cross-section of an electroluminescent device of the prior art. FIG. 2 shows a plan view of the same electroluminescent device. The electroluminescent device, generally indicated by 10, has a substrate 12 on which is located row electrode 14. Thick film dielectric 16 has thin film dielectric 18 thereon. Thin film dielectric 18 is shown with three pixel columns, referred to as 20, 22 and 24, located thereon. The pixel columns contain phosphors to provide the three basic colours viz. red, green and blue. Pixel column 20 has red phosphor 26 located in contact with thin film dielectric 18. Another thin film dielectric 28 is located on red phosphor 26, and column electrode 30 is located on thin film dielectric 28. Similarly, pixel column 22 has green phosphor 32 on thin film dielectric 18, with thin film dielectric 34 and column electrode 36 thereon. Pixel column 24 has blue phosphor 38 on thin film dielectric 18, with thin film dielectric 40 and column electrode 42 thereon.

A particular embodiment of an electroluminescent device of the present invention is illustrated in FIG. 3. The electroluminescent device, generally indicated by 60, has a substrate 62 e.g. alumina, with a metal conductor layer 64 e.g. a gold conductor layer. Thick film dielectric layer 66, which may be PMT-PT, is located on metal conductor layer 64. A smoothing dielectric layer e.g. lead zirconate-titanate, may be applied to the thick film dielectric layer 66; this smoothing layer is not shown in FIG. 3 but is exemplified in Example I.

The non-porous layer of the present invention, 68, is located on thick film dielectric layer 66. Non-porous layer 58 is preferably barium titanate, as described in Example I. Phosphor 70 is located on non-porous layer 53, In the embodiment of Example I, phosphor 70 is of the nominal formula $Mg_xZn_{1-x}$ S: Mn with x=0.1 and doped with 0.4 atomic percent manganese. An upper thin film dielectric layer 72. Which is $Al_2O_3$, and then a layer of indium tin oxide, 74, are located over phosphor 70.

The present invention relates to a novel structure for a thick film electroluminescent display element wherein a barium titanate layer is interposed between the thick film and thin film structures of the element to provide enhanced luminosity and operating life.

The present invention is illustrated by the following examples. The examples describe the fabrication of and test results for electroluminescent elements incorporating a barium titanate layer fabricated using a sot gel process. It is understood that such a layer may be deposited by any means that enables the deposition of a conformal, largely pinhole-free layer.

EXAMPLE I

An electroluminescent element of the Type generally shown in FIG. 3 was fabricated.

The electroluminescent element was formed on a 5 cm×5 cm alumina substrate. A thick film layer structure comprising a gold conductor patterned to form a lower electrode connected to a contact was deposited on the substrate followed by a composite dielectric layer comprising thick film dielectric layer screen printed and fired using PMN-PT based paste 98-42 from MRA of North Adams, Mass. U.S.A. or CL-90-7239 from Heraeus of W. Conshocken. Pa. U.S.A. Two layers of lead zirconate-titanate (PZT) were then deposited onto the substrate by spin coating using a metal organic deposition process and firing. The method is disclosed in the aforementioned PCT patent application WO 00/70917.

A barium titanate layer was deposited on top of the PZT layer on the thick film structure using the following procedure. A barium titanate sol suspension (0.5M) in methoxypropanol was obtained as a preparied product, DBAT 150, from Gelest of Tullytown, Pa. U.S.A. As this suspension tends to have a very short shelf life in air, it was diluted with 2 parts by volume of methanol to 1 part of Gelest suspension to increase the working time in air. The diluted suspension was spin coated onto the thick film structure, and the resultant structure was then fired at a peak temperature of 700° C. for 10 minutes in a belt furnace to form a barium titanate layer approximately 0.1 micrometer thick.

The barium titanate deposition process was repeated twice to increase the thickness of the barium titanate layer to 0.2 micrometers.

A 0.6 micrometer thick manganese-activated magnesium zinc sulphide phosphor film having the nominal formula $Mg_xZn_{1-x}S$: Mn with x=0.1 and doped with 0.4 atomic percent manganese was deposited on the phosphor titanate layer using electron beam evaporation. A 50 nanometer thick film of a thin upper dielectric film consisting of $Al_2O_3$ was deposited an the phosphor film and finally an indium tin oxide layer was deposited on top and patterned to form a top electrode connected to a contact pad.

The entire assembly was covered by a sheet of glass, which was attached to the substrate using an epoxy perimeter seal to isolate the structure from moisture in the atmosphere, leaving the contact pads exposed for electrical connection.

The electroluminance of the completed device, which is a device of the present invention, was measured as a function of peak voltage for an applied 120 Hz bipolar square wave excitation voltage waveform.

A comparative device that was identical except that the barium titanate layer was replaced with a 50 nanometer thick layer of $Al_2O_3$ was fabricated, and the electroluminance was measured.

Figure 4:
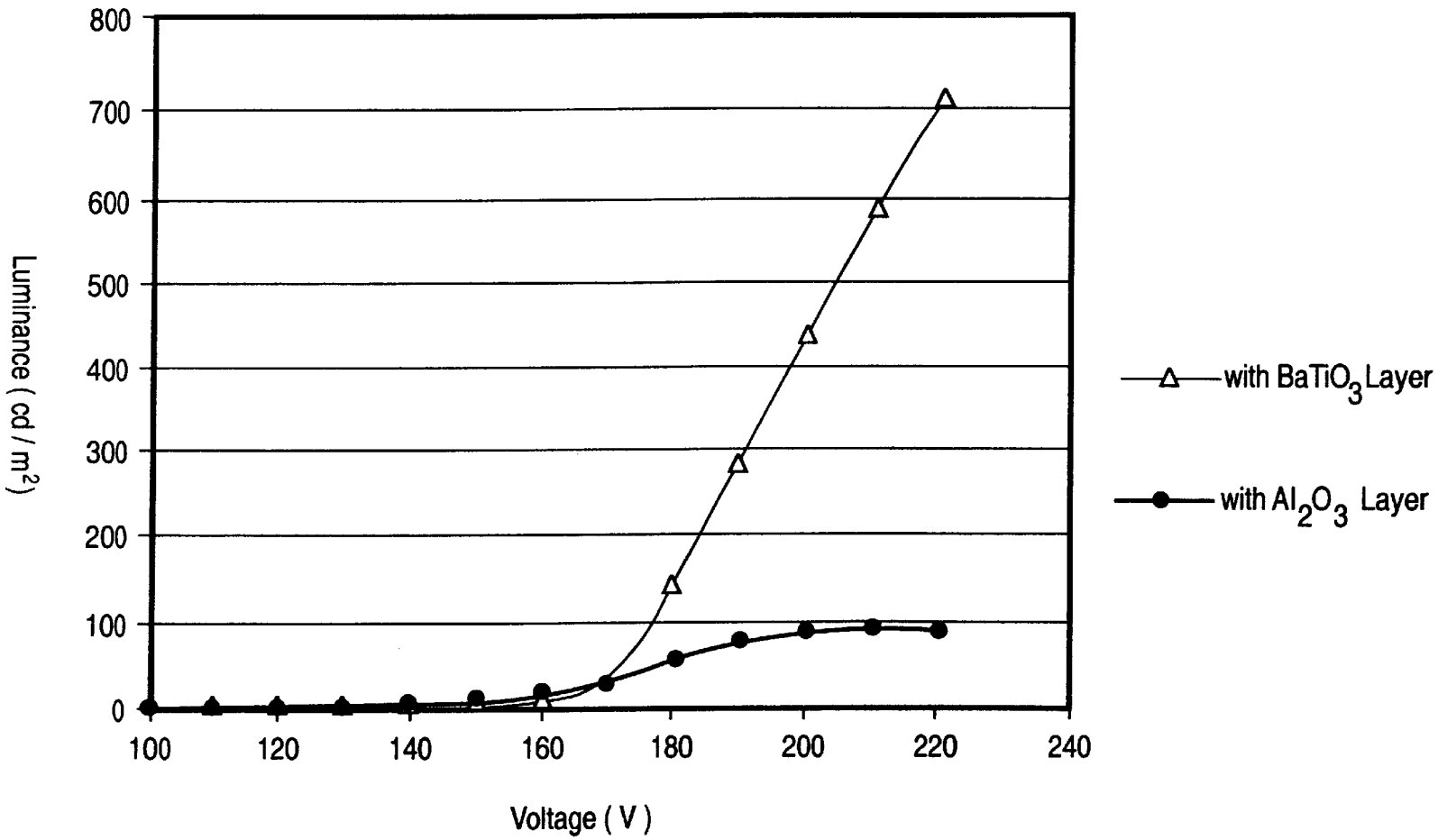
FIG. 4 is a graphical representation of luminance versus applied voltage for two thick film electroluminescent elements having a manganese-activated magnesium zinc sulphide phosphor film, with and without the insertion layer of the present invention.

The results are shown in FIG. 4.

As can be seen from the data, the devices of the invention, with barium titanate layers, have a sharp threshold voltage for the onset of luminance and show a luminance of about 700 candelas per square meter at 200 volts. By contrast, the comparative devices without the barium titanate layer have a more gradual threshold and a luminance of only about 100 candelas per square meter at 200 volts. In additional, the devices with barium titanate show a linear dependence of luminance above the threshold voltage, thereby providing improved utility for gray scale control, compared with the devices without barium titanate which show a non-linear luminance dependence.

EXAMPLE II

An electroluminescent element similar to that of Example I was fabricated, except that a paste having PMN-PT from Ferro Corporation Niagara Falls, U.S.A. was used for the thick film structure in place of the MRA paste and a 1.0 micrometer thick phosphor film comprising cerium-activated strontium suiphide with a cerium concentration of 0.3 atomic percent was used in place of the magnesium zinc sulfide phosphor film. Comparative devices having a 50 nanometer thick layer of $Al_2O_3$ instead of barium titanate were also fabricated.

Figure 5:
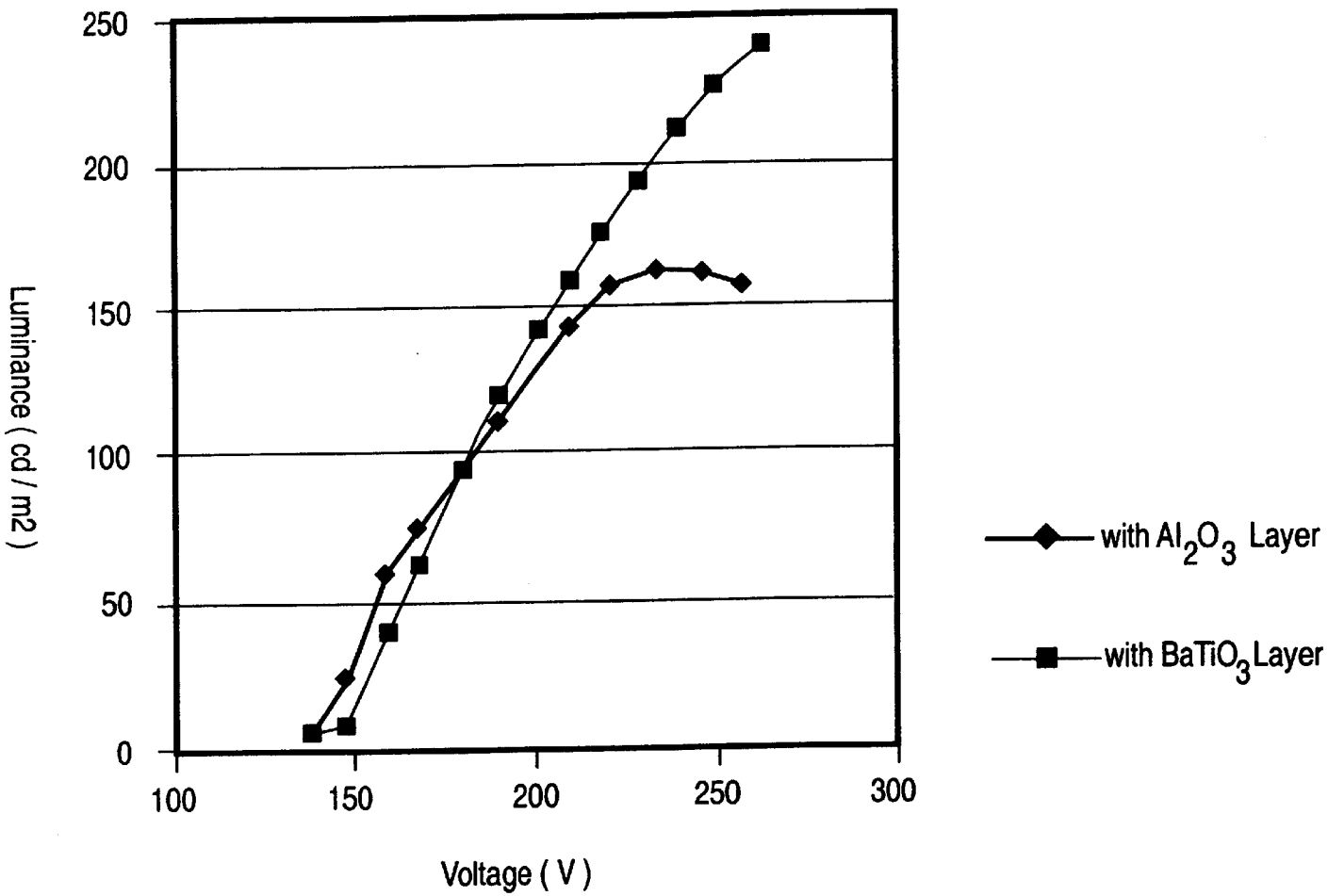
FIG. 5 is a graphical representation of luminance versus applied voltage for two thick film electrolumiescent elements having a cerium activated strontium sulphide phosphor film, with and without the insertion layer of the present invention.

The results are shown in FIG. 5

The test results on the devices of the invention with barium titanate layers, show improved luminance at 260 volts and 120 Hz over the comparative devices with a 50 nanometer thick $Al_2O_3$ layer in place of the barium titanate layer. In addition, the luminance above the threshold voltage was linear with voltage for the devices of the invention, whereas luminance approached a constant value with increasing voltage for the devices without the barium titanate layer, giving the present invention improved utility for gray scale control.

EXAMPLE III

An electroluminescent element similar to that of Example II was fabricated, except that the phosphor film was a 150 nanometer thick film of europium-activated barium thioaluminate deposited according to the methods disclosed in U.S. provisional patent application serial No. 60/232,549 filed Sep. 14, 2000. This barium thioaluminate phosphor is a blue light-emitting phosphor. Comparative devices with a 200 nanometer thick layer of $Al_2O_3$ in place of the barium titanate layer were also fabricated.

Figure 6:
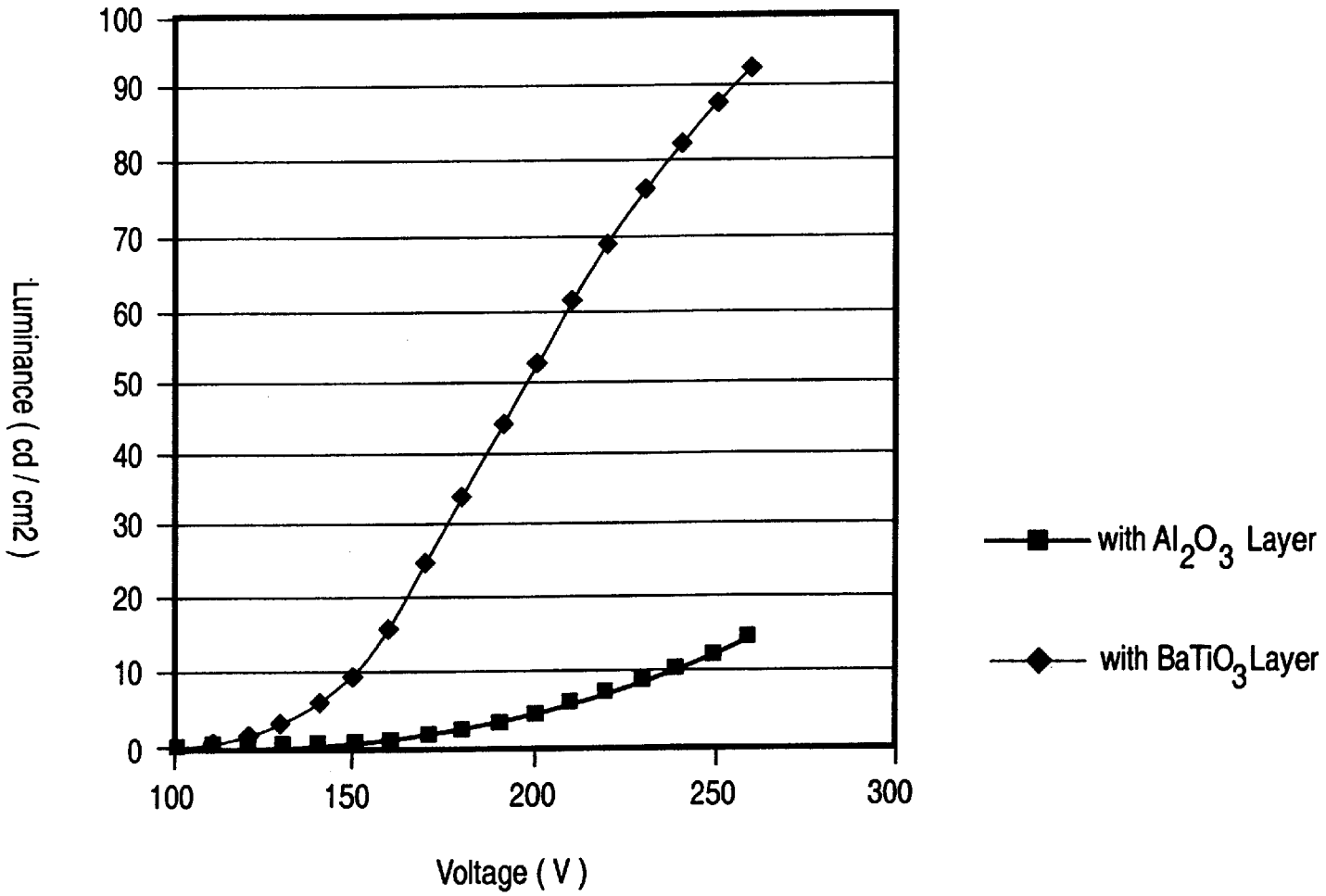
FIG. 6 is a graphical representation of luminance versus applied voltage for two thick film electroluminescent elements having a europium-activated barium thioaluminate phosphor film, with and without the insertion layer of the present invention.

The results are shown in FIG. 6.

The measured luminance of the device of the invention with a barium titanate layer was about 80 candelas per square meter at 250 volts and 120 Hz. The luminance under the same test conditions for the comparative device with a 200 nanometer thick $Al_2O_3$ layer in place of the barium titanate layer was about 10 candelas per square meter.

EXAMPLE IV

An electroluminescent element similar to that of Example I was fabricated except that the phosphor comprised manganese-activated zinc sulphide rather than manganese-activated magnesium zinc sulphide. A comparative device was constructed with a 50 nanometer thick $Al_2O_3$ layer in place of the barium titanate layer i.e. the device of the present invention.

Both devices were operated using a 200 volt 2.4 kilohertz bipolar square wave pulse and the luminance was measured as a function of operating time.

Figure 7:
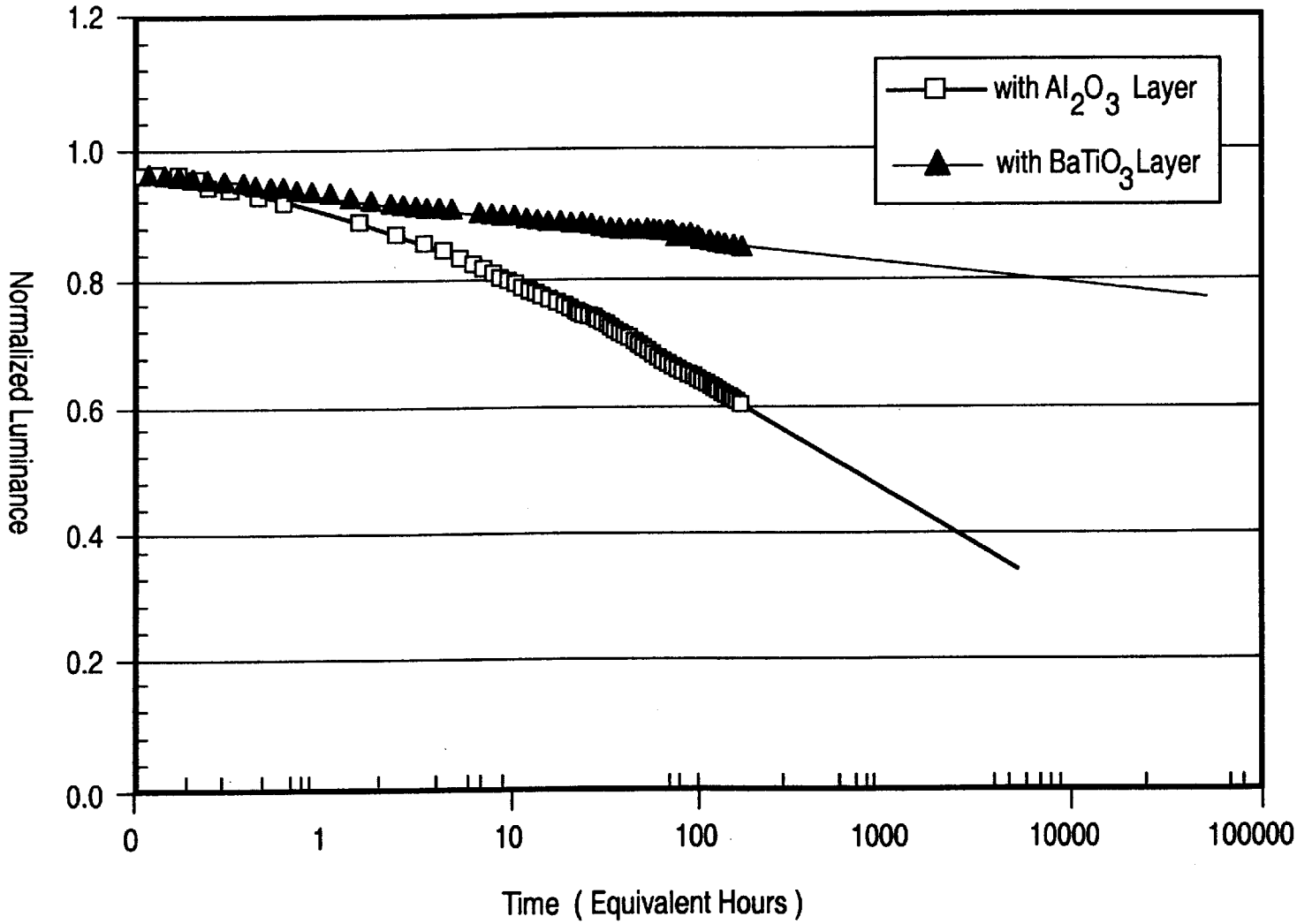
FIG. 7 is a graphical representation of luminance versus operating time for two thick film electroluminescent displays having a manganese-activated zinc sulphide phosphor film, with and without the insertion layer of the present invention.

The results are shown in FIG. 7.

The relative luminance for the two devices is plotted versus operating time on a log scale at an assumed operating frequency of 120 Hz, it being assumed that the degradation rate for the luminance is proportional to the frequency of the applied voltage signal. As can be seen from FIG. 7, the luminance decreases far more slowly in the device with the barium titanate layer i.e. the device of the present invention.

What is claimed is:

1. In a thick film electroluminescent display having a thick film dielectric layer and phosphor layer, the improvement comprising:

an adherent non-porous layer having a thickness of about 0.05 to 0.3 $\mu$m interposed between the thick film dielectric layer and the phosphor layer, said thin non-porous layer comprising a crystalline material having a crystal structure with a permanent or electric-field induced dipole moment;

said non-porous layer being chemically more stable and unreactive with respect to the phosphor layer than the thick film dielectric layer;

said non-porous layer exhibiting reduced diffusion characteristics to atomic species than the thick film dielectric layer.

2. The thick film electroluminescent display of claim 1 in which the crystal structure does not have a centre of inversion symmetry.

3. The thick film electroluminescent display of claim 1 in which the non-porous layer is adjacent both the thick film dielectric layer and the phosphor layer.

4. The thick film electroluminescent display of claim 1, wherein said display further comprises a dielectric smoothing layer or the thick film dielectric layer.

5. The thick film electroluminescent display of claim 1 in which the crystalline material is a ternary or quaternary compound.

6. The thick film electraluminescent display of claim 5 in which the non-porous layer is paraelectric.

7. The thick film electroluminescent display of claim 5 in which the non-porous layer is ferroelectric.

8. The thick film electroluminescent display of claim 5 in which the non-porous layer is anti-ferroelectric.

9. The thick film etectroluminesoent display of claim 5 in which the non-porous layer has a relative dielectric constant of greater than 20.

10. The thick film elsctroluminescent display of claim 9 in which the non-porous layer has a relative dielectric constant of greater than 50.

11. The thick film electroluminescent display of claim 9 in which the non-porous layer has a relative dielectric constant of greater than 100.

12. The thick film electroluminescent of claim 9 in which the non-porous layer is formed from a compound of the formula $Ba_xSr_{1-x}TiO_3$, where $0 \leqq x \leqq 1$, or $BaTa_2O_6$.

13. The thick film electroluminescent display of claim 9 in which the non-porous layer is formed from barium titanate.

14. The thick film electroluminescent display of claim 9 in which a thin film dielectric layer is applied on the phosphor layer.

15. The thick film electroluminescent display of claim 14 in which the thin film dielectric layer is $Al_2O_3$.

16. The thick film electroluminescent display of claim 14 in which the thin film dielectric layer is $BaTiO_3$.

17. The thick film electroluminescent display of claim 14 in which a layer of indium tin oxide is applied over the thin film dielectric layer.

18. The thick film display of claim 1, wherein said non-porous layer is not directly adjacent the thick film dielectric layer.

19. The thick film display of claim 18, wherein the non-porous layer is formed from a compound of the formula $BaxSr_{1-x}TiO_3$, where $0 \leqq x \leqq 1$, or $BaTa_2O_6$.

20. The thick film display of claim 19, wherein the non-porous layer is formed from barium titanate.

21. In a thick film electroluminescent display having a thick film dielectric layer, a dielectric smoothing layer on the thick film dielectric layer and a phosphor layer, the improvement comprising:

an adherent non-porous layer deposited adjacent to the phosphor layer and the dielectric smoothing layer, said non-porous layer comprising a crystalline material having a crystal structure with a permanent or electric-field induced dipole moment.

22. The thick film electroluminescent display of claim 21, in which the non-porous layer is formed from a compound of the formula $BaxSr_{1-x}TiO_3$, where $0 \leqq x \leqq 1$ or $BaTa_2O_6$.

23. The thick film electroluminescent display of claim 21 in which the non-porous layer is formed from barium titanate.

24. In a thick film electroluminescent display having a thick film dielectric layer and phosphor layer, the improvement comprising:

an adherent non-porous layer interposed between the thick film dielectric layer and the phosphor layer, said non-porous layer being formed from $BaTa_2O_6$.

25. In a thick film electroluminescent display having a thick film dielectric layer and a phosphor layer, the improvement comprising:

an adherent non-porous layer interposed between the thick film dielectric layer and the phosphor layer but not directly adjacent the thick film dielectric layer, said non-porous layer comprising a crystalline material having a crystal structure with a permanent or electric-field induced dipole moment;

said non-porous layer being chemically more stable and unreactive with respect to the phosphor layer than the thick film dielectric layer;

said non-porous layer exhibiting reduced diffusion characteristics to atomic species than the thick film dielectric layer.

26. The thick film display of claim 25, wherein the non-porous layer is formed from a compound of the formula $BaxSr_{1-x}TiO_3$, where $0 \leqq x \leqq 1$, or $BaTa_2O_6$.

27. The thick film display of claim 26, wherein the non-porous layer is formed from barium titanate.

* * * * *

UNITED STATES PATENT AND TRADEMARK OFFICE

CERTIFICATE OF CORRECTION

PATENT NO. : 6,589,674 B2
DATED : July 8, 2003
INVENTOR(S) : Li et al.

It is certified that error appears in the above-identified patent and that said Letters Patent is hereby corrected as shown below:

Column 1,
Line 32, after “made” delete “sufficisntly” and insert therefor -- sufficiently --
Line 51, after “using” delete “sot” and insert therefor -- sol --

Column 2,
Line 46, after “any” delete “residue” and insert therefor -- residues --

Column 3,
Line 13, after “a” delete “crystaline” and insert therefor -- crystalline --
Line 44, after “indium” delete “tip” and insert therefor -- tin --

Column 4,
Line 47, after “lead” delete “titanate zirconate” and insert therefor -- zirconate titanate --
Line 56, after “greater” delete “Than” and insert therefor -- than --

Column 5,
Line 3, after “by the” delete “Sol” and insert therefor -- sol --
Line 21, after “display” and insert therefor -- . --
Line 44, after “as” (1st occurrence) delete “wall” and insert therefor -- well --
Line 56, after “reaction .” delete “PIT” and insert therefor -- PZT --

Column 6,
Line 23, after “the” delete “real” and insert therefor -- areal --
Line 47, after “($A1_2O_3$)” and insert therefor -- . --

Column 7,
Line 13, before “is” delete “58” and insert therefor -- 68 --
Line 18, after “72” delete “. Which” and insert therefor -- which --
Line 28, after “a” delete “sot” and insert therefor -- sol --
Line 34, after “the” delete “Type” and insert therefor -- type --
Line 51, after “a” delete “preparied” and insert therefor -- prepared --
Line 66, after “the” delete “phosphor” and insert therefor -- barium --

Column 8,
Line 26, after “In” delete “additional” and insert therefor -- addition --
Line 38, after “strontium” delete “suiphide” and insert therefor -- sulphide --

Column 9,
Line 59, after “film” delete “etectroluminesoent” and insert therefor
-- electroluminescent --

UNITED STATES PATENT AND TRADEMARK OFFICE

CERTIFICATE OF CORRECTION

PATENT NO. : 6,589,674 B2
DATED : July 8, 2003
INVENTOR(S) : Li et al.

It is certified that error appears in the above-identified patent and that said Letters Patent is hereby corrected as shown below:

Column 10,
Line 22, before "$T_iO_3$" and delete "$BaxSr_{1-x}$" and insert therefor -- $Ba_x\ Sr_{1-x}$ --
Line 36, after "formula" delete "$BaxSr_{1-x}$" and insert therefor -- $Ba_x\ Sr_{1-x}$ --
Line 63, before "$T_iO_3$" and delete "$BaxSr_{1-x}$" and insert therefor -- $Ba_x\ Sr_{1-x}$ --

Signed and Sealed this

Fifteenth Day of June, 2004

JON W. DUDAS
*Acting Director of the United States Patent and Trademark Office*